US008052141B2

(12) United States Patent
Yamagishi

(10) Patent No.: US 8,052,141 B2
(45) Date of Patent: Nov. 8, 2011

(54) RECORDING-MEDIUM STORAGE DEVICE AND IMAGE FORMING APPARATUS

(75) Inventor: Masaru Yamagishi, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 251 days.

(21) Appl. No.: 12/153,757

(22) Filed: May 23, 2008

(65) Prior Publication Data

US 2008/0298873 A1 Dec. 4, 2008

(30) Foreign Application Priority Data

May 31, 2007 (JP) ..... 2007-145412
Feb. 28, 2008 (JP) ..... 2008-047900

(51) Int. Cl.
*B65H 1/00* (2006.01)

(52) U.S. Cl. ..... 271/171; 271/223

(58) Field of Classification Search ..... 271/171, 271/223

See application file for complete search history.

(56) References Cited

U.S. PATENT DOCUMENTS

| | | | | |
|---|---|---|---|---|
| 5,737,682 | A | 4/1998 | Yamagishi | |
| 6,279,900 | B1 | 8/2001 | Yamagishi | |
| 6,393,252 | B1 | 5/2002 | Yamagishi | |
| 6,530,569 | B2 | 3/2003 | Yamagishi | |
| 6,690,911 | B2 | 2/2004 | Yamagishi | |
| 6,711,377 | B2 | 3/2004 | Yamagishi | |
| 2006/0087073 | A1 | 4/2006 | Yamagishi | |
| 2006/0164456 | A1 | 7/2006 | Yamagishi et al. | |
| 2006/0222434 | A1 * | 10/2006 | Kitamura et al. | 400/624 |

FOREIGN PATENT DOCUMENTS

| | | |
|---|---|---|
| JP | 05-330670 | 12/1993 |
| JP | 10-265060 | 10/1998 |
| JP | 2001-310824 | 11/2001 |
| JP | 2006-188357 | 7/2006 |

* cited by examiner

*Primary Examiner* — Michael McCullough
(74) *Attorney, Agent, or Firm* — Harness, Dickey & Pierce, P.L.C.

(57) ABSTRACT

A first engaging member makes a first engagement with a first locking member to lock an edge guiding unit. A second engaging member makes a second engagement with a second locking member to lock the edge guiding unit. The first locking member is movable to a first retract position and a second retract position. When the first locking member moves to the first retract position, the second engagement is released in conjunction with a release of the first engagement, and when the first locking member moves to the second retract position, the first engagement is released while maintaining the second engagement.

18 Claims, 10 Drawing Sheets

RECORDING-MEDIUM STORAGE DEVICE AND IMAGE FORMING APPARATUS

CROSS-REFERENCE TO RELATED APPLICATIONS

The present application claims priority to and incorporates by reference the entire contents of Japanese priority documents, 2007-145412 filed in Japan on May 31, 2007 and 2008-047900 filed in Japan on Feb. 28, 2008.

BACKGROUND OF THE INVENTION

1. Field of the Invention

The present invention relates to a recording-medium storage device and an image forming apparatus.

2. Description of the Related Art

A recording-medium storage device (e.g., a paper feed tray) installed in an image forming apparatus is used to stack a recording medium (hereinafter, "paper") and feed the paper to the image forming apparatus such that an image is formed thereon. The recording-medium storage device implements a stacking position determining mechanism for a paper stack. The stacking position determining mechanism includes edge guiding units, viz., an end fence and a plurality of side fences. The side fences guide the lateral edges of the paper stack with respect to a feeding direction, while the end fence guides the rear edge of the paper stack with respect to the feeding direction. The stacking position determining mechanism enables a user to precisely determine the position of the paper stack thereby preventing image misalignment on the paper or incorrect feed timing of the paper.

Recently, a universal paper feed tray compatible to various paper sizes has become mainstream. Such a universal paper feed tray enables the user to stack paper of different paper sizes for image formation. Consequently, user-friendliness is a critical issue while using a universal paper feed tray.

Conventionally, there are two position determining mechanisms corresponding to standard paper sizes. One mechanism is a notching mechanism in which a notch engagement is provided at a position corresponding to each standard paper size. The other mechanism is a latching mechanism (free stop mechanism), as disclosed in Japanese Patent Application Laid-open No. 2001-310824, in which a multiple latch engagement is provided for arbitrarily determining a position corresponding to the paper size. Generally, a conventional recording-medium storage device implements either one of the notching mechanism and the latching mechanism.

The notching mechanism suffices the needs of a user who mainly uses paper of standard paper sizes for image formation. However, the notching mechanism is not suitable for a professional user who uses paper of a free paper size. On the other hand, the latching mechanism is suitable for paper of standard paper sizes as well as a free paper size. Moreover, by using the latching mechanism, the user can reliably guide the edges of the paper stack. However, in that case, it is a requisite that the paper stack is neatly aligned to prevent problems such as image misalignment on the paper or incorrect feed timing of the paper.

Recently, a paper feed tray as disclosed in Japanese Patent Application Laid-open No. 2006-188357, which automatically recognizes the paper size of the paper stack by detecting the position of each edge guiding unit, is being increasingly used. As the paper sizes recognizable by the paper feed tray increase, it becomes more necessary to precisely lock the edge guiding units at desired positions corresponding to the standard paper sizes. Thus, the notching mechanism is more effective in such a case. However, as described above, the notching mechanism is not suitable for determining the positions of the edge guiding units corresponding to a free paper size. That is, it is difficult to determine positions of the edge guiding units corresponding to the standard paper sizes as well as a free paper size. Moreover, even if the edge guiding units are locked at a position corresponding to any paper size, it is necessary to maintain high operability while locking the edge guiding units at a particular position or moving them to another position.

SUMMARY OF THE INVENTION

It is an object of the present invention to at least partially solve the problems in the conventional technology.

According to an aspect of the present invention, there is provided a recording-medium storage device including a recording-medium storing unit that is arranged in a main body of the recording-medium storage device and stores therein a recording medium; an edge guiding unit that guides an edge of the recording medium and is movable in a direction of guiding a conveying edge of the recording medium, the edge guiding unit including a first locking member and a second locking member; a first engaging member that is arranged in the main body and makes a first engagement with the first locking member to lock the edge guiding unit; and a second engaging member that is arranged in the main body and makes a second engagement with the second locking member to lock the edge guiding unit. The first locking member is movable to a first retract position and a second retract position. When the fist locking member moves to the first retract position, the second engagement is released in conjunction with a release of the first engagement, and when the fist locking member moves to the second retract position, the first engagement is released while maintaining the second engagement.

Furthermore, according to another aspect of the present invention, there is provided an image forming apparatus comprising a recording-medium storage device including a recording-medium storing unit that is arranged in a main body of the recording-medium storage device and stores therein a recording medium; an edge guiding unit that guides an edge of the recording medium and is movable in a direction of guiding a conveying edge of the recording medium, the edge guiding unit including a first locking member and a second locking member; a first engaging member that is arranged in the main body and makes a first engagement with the first locking member to lock the edge guiding unit; and a second engaging member that is arranged in the main body and makes a second engagement with the second locking member to lock the edge guiding unit. The first locking member is movable to a first retract position and a second retract position. When the fist locking member moves to the first retract position, the second engagement is released in conjunction with a release of the first engagement, and when the fist locking member moves to the second retract position, the first engagement is released while maintaining the second engagement.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
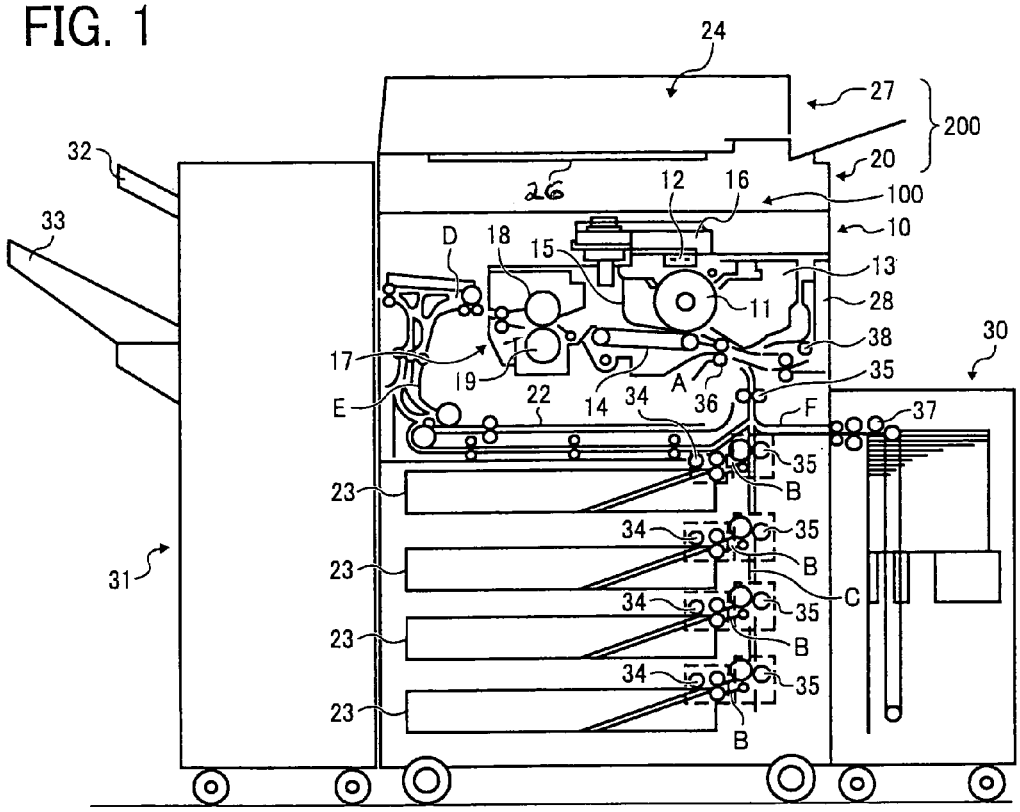
FIG. 1 is a schematic diagram of an image forming apparatus in which a recording-medium storage device according to an embodiment of the present invention is installed.

Exemplary embodiments of the present invention are described in detail below with reference to the accompanying drawings. The present invention is not limited to these exemplary embodiments. FIG. 1 is a schematic diagram of an image forming apparatus 10 in which a recording-medium storage device according to a first embodiment of the present invention is installed. The image forming apparatus 10 includes an image forming unit 100 that includes an image carrier 11, which is formed with a drum-shaped photosensitive element, a charging unit 12, a developing unit 13, an image transfer unit 14, a cleaning unit 15, a laser writing unit 16, and a fixing unit 17. The laser writing unit 16 is arranged at the top portion of the image forming unit 100, and includes a laser scanning optical system (not shown) including a light source formed with a laser diode and the like, a rotating polygon mirror, a motor, an fθ lens, a mirror, and the like. The fixing unit 17 is arranged on the left side of the cleaning unit 15, and includes a fixing roller 18 with an inbuilt heater and a pressure roller 19 that presses a recording medium against the fixing roller 18 from downwards.

A duplex unit 22 is arranged beneath the image forming unit 100. Four paper feed trays 23, which form a four-stage recording-medium storage device, are arranged beneath the duplex unit 22. A recording medium, such as a paper or an OHP transparency, (hereinafter, "a paper") can be stacked in the paper feed trays 23. A feeding unit 70 and a feed path B are separately arranged for the paper feed trays 23. The feeding unit 70 feeds a sheet of paper at a time from the paper feed tray 23 to a common conveying path C via the feed path B. The paper in the common conveying path C is then conveyed to the image transfer unit 14, which is arranged beneath the image carrier 11.

The duplex unit 22 is used to reverse the paper to form images on both sides of the paper. First, upon receiving the paper, the image transfer unit 14 transfers an image onto a first side of the paper and conveys the paper to the fixing unit 17. The fixing unit 17 fixes the transferred image onto the first side of the paper. Then, instead of being conveyed to a post-print processing unit 31, the paper is conveyed to the duplex unit 22 via a reverse conveying path E, which is split from a paper discharging path D leading to the post-print processing unit 31. The paper is reversed at the duplex unit 22 and is conveyed to the image transfer unit 14 via a re-conveying path A. The image transfer unit 14 then transfers an image onto a second side of the paper.

An image reading unit 24 and an exposure glass 26 are arranged above the image forming unit 100. An automatic document feeding (ADF) unit 27 covers the exposure glass 26 from above in an openable and closable manner with respect to the exposure glass 26. The image reading unit 24, the exposure glass 26, the ADF unit 27, and an optical reading unit 20 form an image reading device 200. A manual paper feeding tray 28 is arranged in an openable and closable manner on the right surface of the image forming apparatus 10. A user can manually feed a paper to the common conveying path C from the manual paper feeding tray 28. Moreover, a large capacity tray unit 30 is attached to the right side of the image forming apparatus 10. It is possible to stack a large number of sheets of paper in the large capacity tray unit 30 in an elevatable manner. The paper is then fed to the common conveying path C via a feed path F by pickup roller 37.

Figure 2:
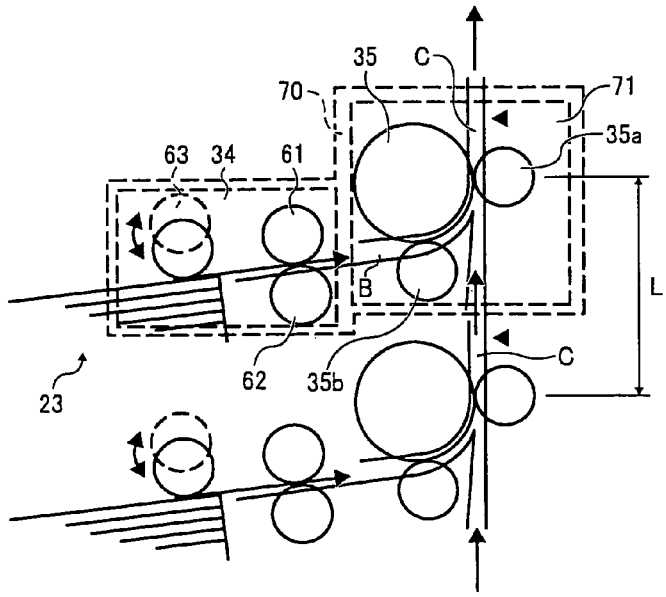
FIG. 2 is a schematic diagram of a feeding unit of the image forming apparatus shown in FIG. 1.

FIG. 2 is an enlarged view of the feeding unit 70. As described above, the feeding unit 70 is arranged separately for each of the four paper feed trays 23. A paper separation unit 34 in each feeding unit 70 includes a pickup roller 63, and a pair of a feed roller 61 and a feed reverse roller 62. The feed reverse roller 62 is pressure-biased against the feed roller 61. The pickup roller 63, and the pair of the feed roller 61 and the feed reverse roller 62 are used to separate and feed the uppermost sheet of paper from the paper stack in the corresponding paper feed tray 23. That is, the paper separation unit 34 implements a feed reverse roller (FRR) type feeding unit.

The sheet of paper separated in the paper separation unit 34 is fed to a conveying unit 71 in the corresponding feeding unit 70 via the feed path B. The conveying unit 71 includes a grip roller 35 against which a first bias roller **35*a* and a second bias roller 35*b* are pressure-biased. The grip roller 35, the first bias roller 35*a*, and the second bias roller 35*b* nip the conveyed paper toward the common conveying path C. A guiding portion 72 is a bent portion in each paper feed tray 23 where the corresponding feed path B merges into the common conveying path C. The four feeding units 70 are vertically arranged, each separated by a distance L from the neighboring feeding unit 70. The paper fed from each paper feed tray 23 is conveyed to the image forming unit 100** via the common conveying path C.

The post-print processing unit 31 is arranged at the left side of the image forming apparatus 10. The post-print processing unit 31 receives paper with an image transferred thereon via the paper discharging path D. The post-print processing unit 31 either discharges the paper as it is to an upper catch tray 32, or performs a finishing process such as spiral binding or punching with respect to the paper before discharging the paper to either one of the upper catch tray 32 and a lower catch tray 33.

When a user sets an original in the image reading device 200 and presses a start switch (not shown), then the optical reading unit 20 reads image data from the original and temporarily stores the image data in a storage unit (not shown). At the same time, a driving unit (not shown) starts rotating the image carrier 11 in the clockwise direction. The surface of the image carrier 11 thus gets uniformly charged by the charging unit 12. Consequently, the laser writing unit 16 obtains the image data from the storage unit and performs laser writing of the image data on the charged surface of the image carrier 11 such that an electrostatic latent image is formed thereon. The developing unit 13 then develops the electrostatic latent image into a toner image by transferring toner onto the electrostatic latent image. The toner image is then conveyed to the image. transfer unit 14.

Meanwhile, based on an image forming (printing) request, one of the paper feed trays 23 is selected for feeding a sheet of paper on which the toner image is to be transferred. The corresponding feeding unit 70 then performs paper feeding. That is, first, the paper separation unit 34 separates the uppermost sheet of paper from the paper stack in the selected paper feed tray 23 and feeds the separated sheet of paper to the conveying unit 71. The grip roller 35, the first bias roller 35*a*, and the second bias roller 35*b* nip the paper upward via the common conveying path C to a registration roller 36, which is not yet rotating. Upon reaching the registration roller 36, the conveyance of the paper comes to a temporary halt. As a result, a paper slack is formed at the registration roller 36. Subsequently, when the toner image formed on the image carrier 11 reaches the image transfer unit 14, the registration roller 36 starts rotating such that the paper is also conveyed to the image transfer unit. 14.

The image transfer unit 14 transfers the toner image onto the paper. The paper is then conveyed to the fixing unit 17 such that the fixing roller 18 and the pressure roller 19 apply heat and pressure to the toner image. As a result, the toner image is fixed to the paper. The paper with a fixed toner image thereon is conveyed to the post-print processing unit 31 via the paper discharging path D and then discharged to either one of the upper catch tray 32 and the lower catch tray 33. Meanwhile, after the toner image is transferred onto the paper from the image carrier 11, the cleaning unit 15 removes the residual toner from the surface of the image carrier 11 such that another toner image can be formed thereon.

In the case of duplex image formation, after forming an image on the first side of the paper, the paper is returned to the duplex unit 22 via the reverse conveying path E, which bifurcates from the paper discharging path D. The paper gets reversed at the duplex unit 22, and is re-conveyed to the registration roller 36 via the re-conveying path A and then to the image transfer unit 14. The image transfer unit 14 transfers a toner image on the second side of the paper. The fixing unit 17 then fixes that toner image to the second side of the paper. The paper with a fixed toner image on both sides thereof is conveyed to the post-print processing unit 31 via the paper discharging path D and then discharged to either one of the upper catch tray 32 and the lower catch tray 33.

Figure 3:
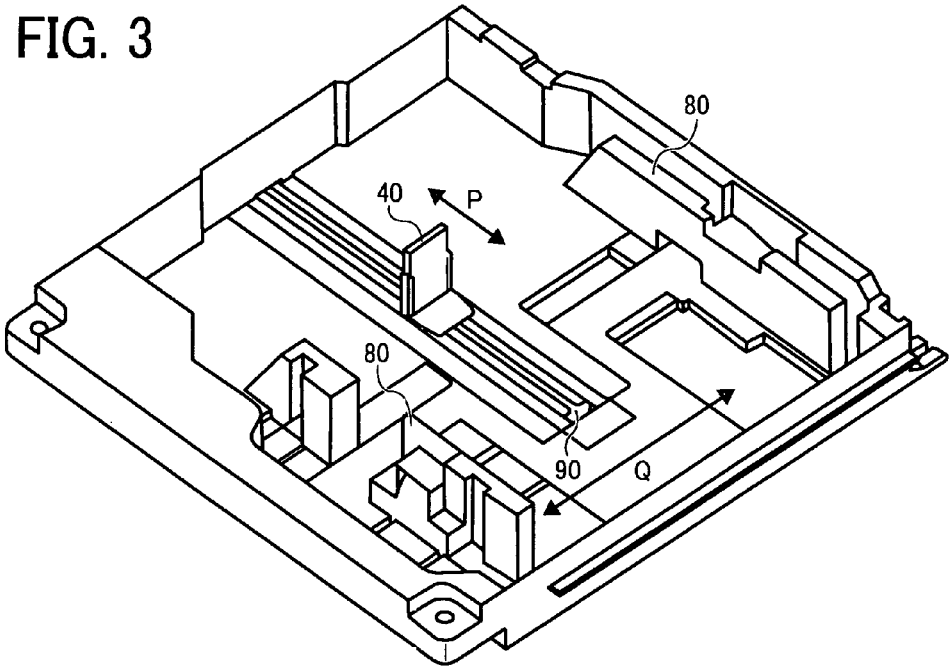
FIG. 3 is a perspective view of a paper feed tray as the recording-medium storage device according to the embodiment.

FIG. 3 is a perspective view of the paper feed tray 23 pulled out of the feeding unit 70. Each paper feed tray 23 includes an end fence 40 and a pair of side fences 80. The side fences 80 are arranged on a paper stacking member in the paper feed tray 23. The side fences 80 function as an edge guiding unit for guiding the lateral edges of the paper stack with respect to a feeding direction. The side fences 80 are movable relative to each other in a direction indicated by a two-headed arrow Q (perpendicular to the feeding direction). The end fence 40 is also an edge guiding unit that guides the rear edge of the paper stack with respect to a feeding direction. The end fence 40 is slidable on a guiding unit 90, which is arranged on the bottom surface of the paper stacking member, in a direction indicated by a two-headed arrow P (feeding direction).

Figure 4:
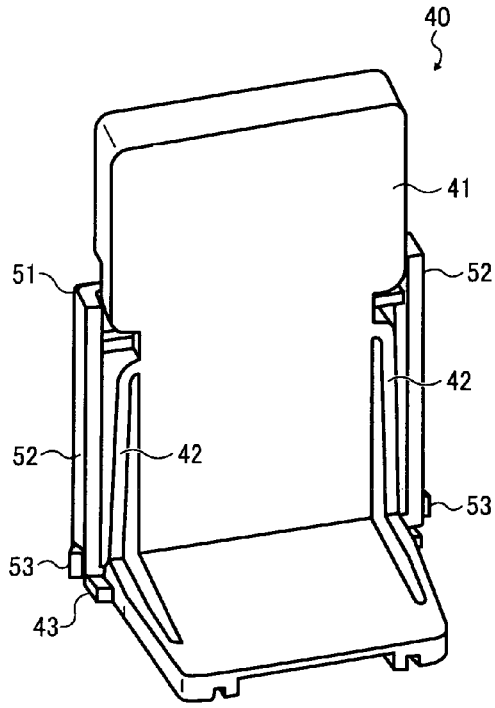
FIG. 4 is a perspective view of an end fence of the paper feed tray.
Figure 8:
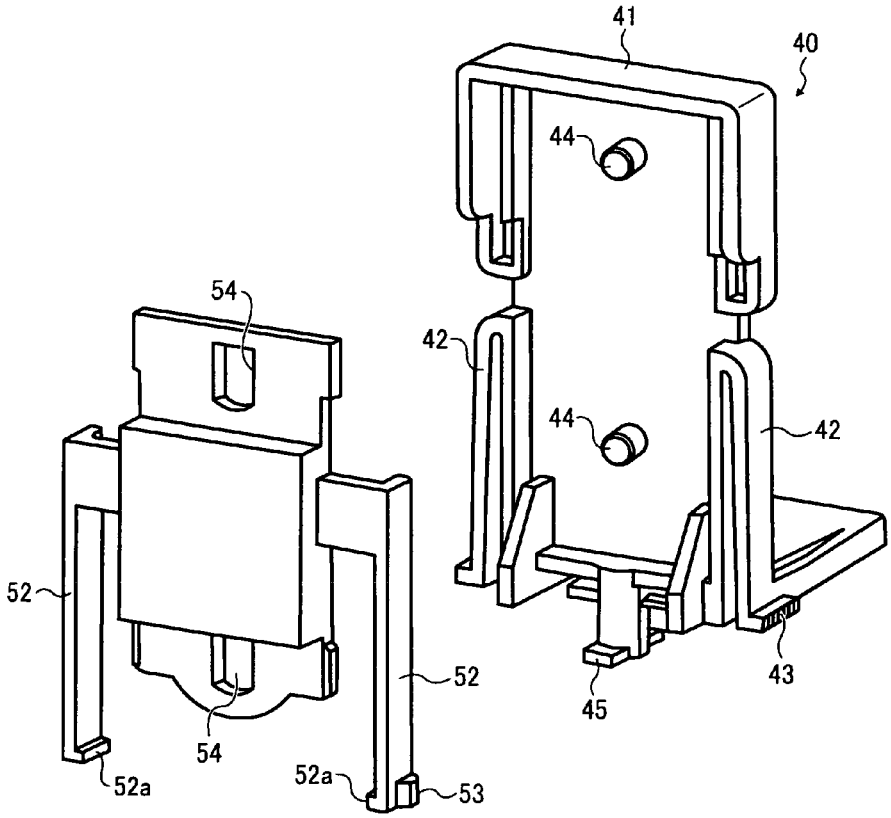
FIG. 8 is an exploded perspective view of the end fence.

As shown in FIGS. 4 and 8, the end fence 40 includes an end fence body 41 and a lock releasing member 51. The lock releasing member 51 is used to release the end fence 40 from a locked state on the guiding unit 90 such that the end fence 40 can be moved to another position. An elastic member 42 is arranged at the left side as well as the right side of the end fence body 41. The pair of elastic members 42 determines a position of the end fence 40 corresponding to paper of a free paper size. A latch nail 43 is arranged at the bottom end of each elastic member 42. An elastic arm 52 is arranged at the left side as well as the right side of the lock releasing member 51. The pair of elastic arms 52 determines a position of the end fence 40 corresponding to paper of a standard paper size. A notch nail 53 is arranged at the bottom end of each elastic arm 52. The latch nails 43 and the notch nails 53 extend outward from the end fence 40. The notch nails 53 are arranged at a position above the latch nails 43. Meanwhile, the paper of standard paper size is, e.g., an A4 size paper, a B4 size paper, and a B5 size paper. On the other hand, a free paper size is a paper size other than a standard paper size.

The end fence body 41 and the lock releasing member 51 are arranged independent of each other. A guide pin 44 in the end fence body 41 fits in a vertical elongated hole 54 in the lock releasing member 51 such that the lock releasing member 51 can vertically slide with respect to the end fence body 41. When the lock releasing member 51 is assembled with the end fence body 41, each elastic arm 52 overlaps the elastic member 42 on the same side from outside. In that case, when the elastic arms 52 are subjected to elastic deformation, the elastic members 42 also get elastically deformed in the same direction as that of the corresponding elastic arms 52.

Figure 5:
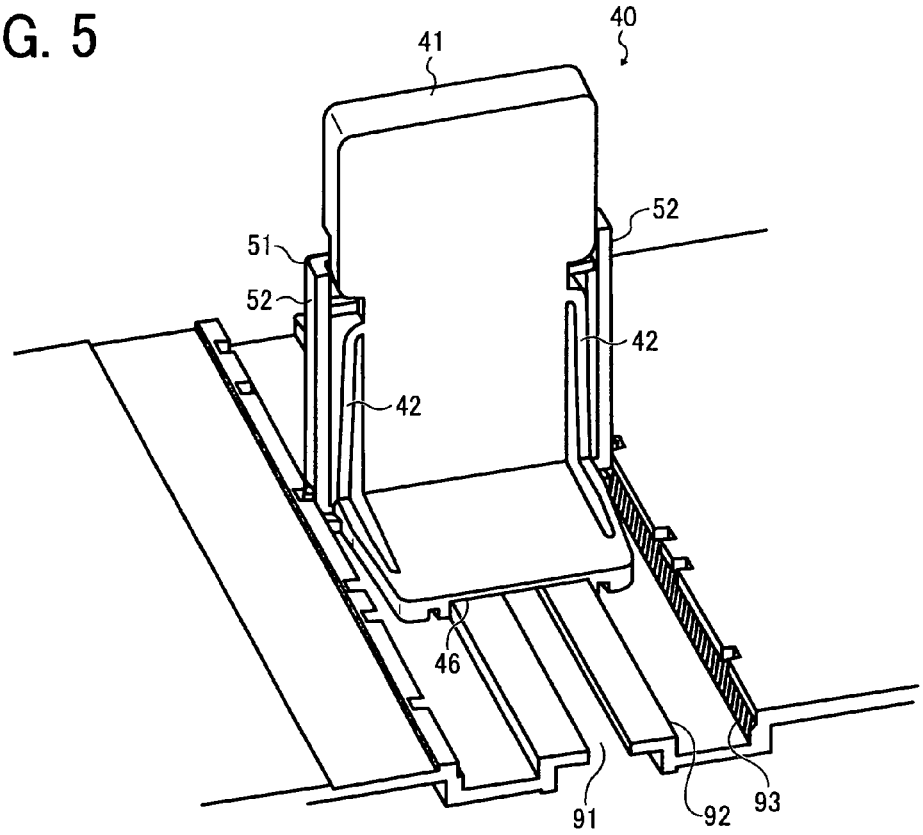
FIG. 5 is a perspective view of the end fence mounted on the paper feed tray.
Figure 6:
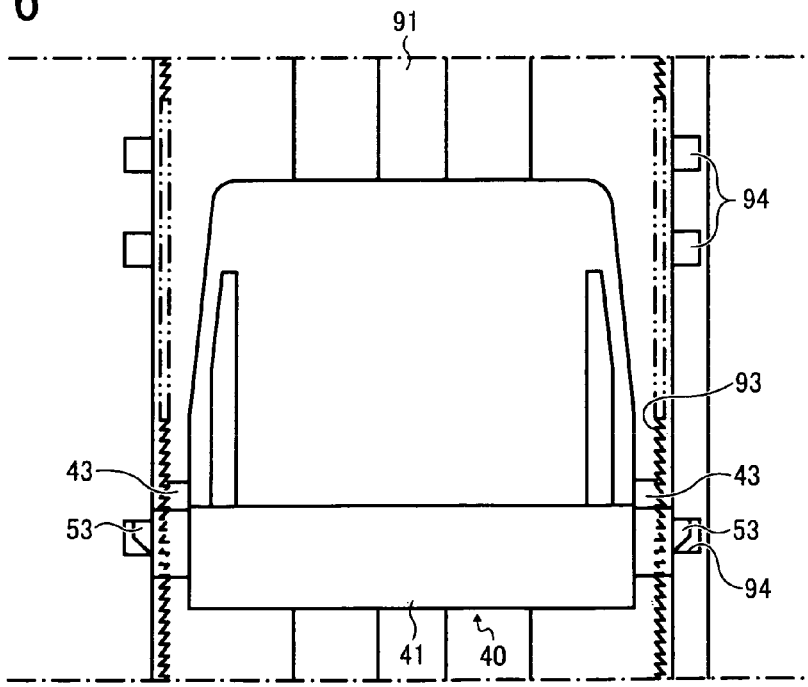
FIG. 6 is a plain view of the end fence mounted on the paper feed tray.
Figure 7:
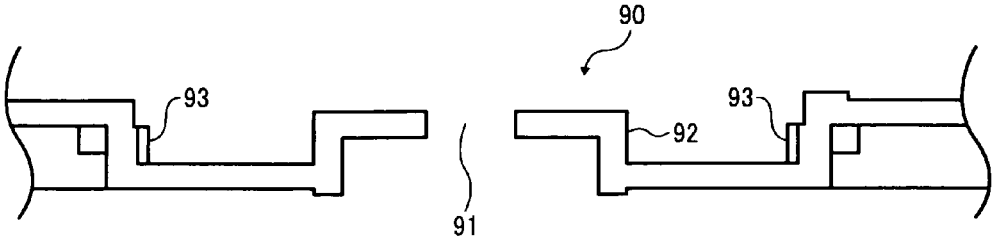
FIG. 7 is a cross section of the guiding unit.
Figure 11:
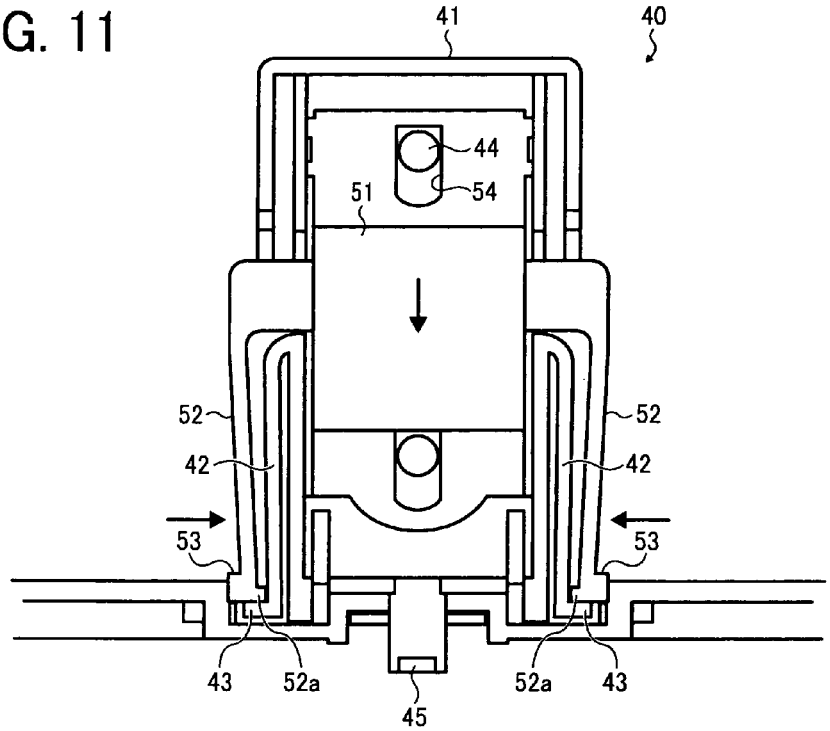
FIG. 11 is a cross section of the end fence in the first retract position.
Figure 13:
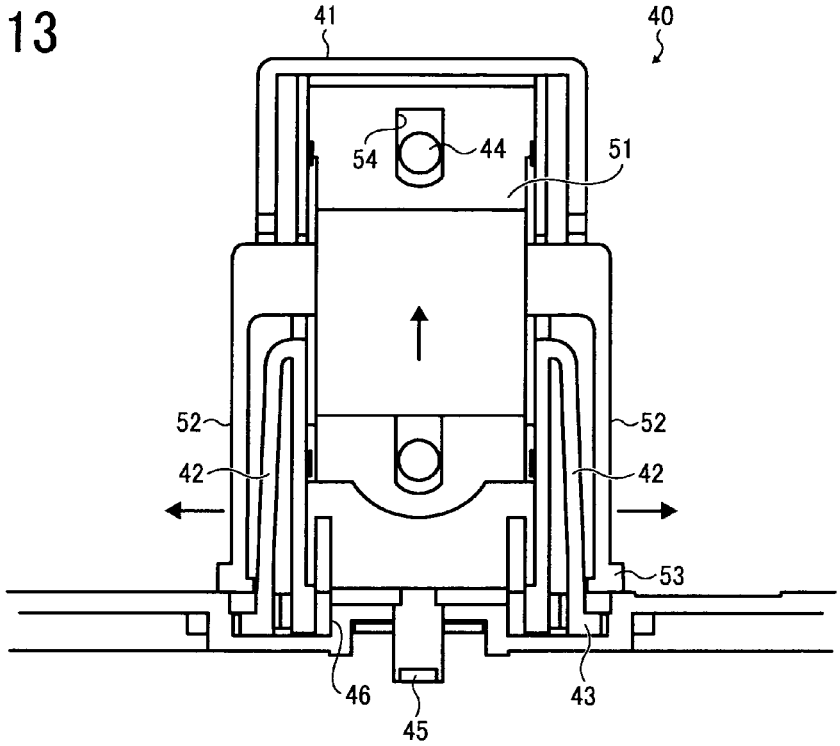
FIG. 13 is a cross section of the end fence in the second retract position.

As shown in FIGS. 5 and 7, the guiding unit 90 includes a slot 91 and a rail 92. A locking member 45 arranged at the base of the end fence body 41 fits in the slot 91 (see FIGS. 11 and 13) such that the end fence 40 is maintained stable on the paper feed tray 23. Similarly, an engaging member 46 arranged at the base of the end fence body 41 engages with the rail 92 such that the sliding direction of the end fence 40 is controlled (see FIG. 13).

A latch engaging member 93 is arranged on each of two side walls of the guiding unit 90. Each latch engaging member 93 is arranged to face the rail 92 and includes a plurality of grooves that resemble teeth of a saw blade. Each latch nail 43 engages with one of the grooves of the latch engaging member 93 on the same side. A plurality of notch engaging members 94 are arranged on each side wall at predetermined positions above the latch engaging member 93 on the same side along the rail 92. Each notch engaging member 94 is a rectangular slot with which the notch nail 53 on the same side engages. Because the latch engaging members 93 includes a plurality of grooves, the position at which the latch nails 43 engage with the corresponding latch engaging members 93 can be adjusted to match with a rear edge of paper of a free paper size. On the other hand, the notch engaging members 94 are arranged such that the position at which the notch nails 53 engage therewith matches with a rear edge of paper of a standard paper size (e.g., an A4 size paper, an A5 size paper, a B4 size paper, a B5 size paper, and a postcard size paper). Meanwhile, it is desirable that each elastic member 42 imparts outwardly elastic force on the corresponding latch engaging member 93 and each elastic arm 52 imparts outwardly elastic force on the corresponding notch engaging member 94.

Figure 9:
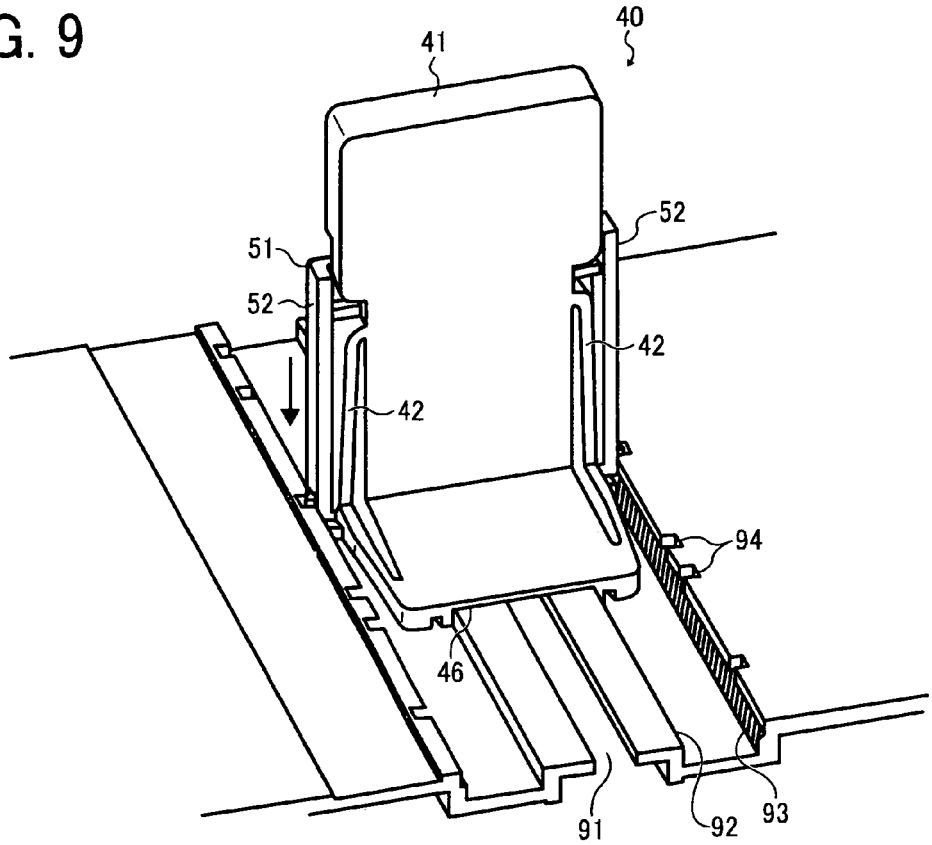
FIG. 9 is a perspective view of the end fence in a locked state.
Figure 10:
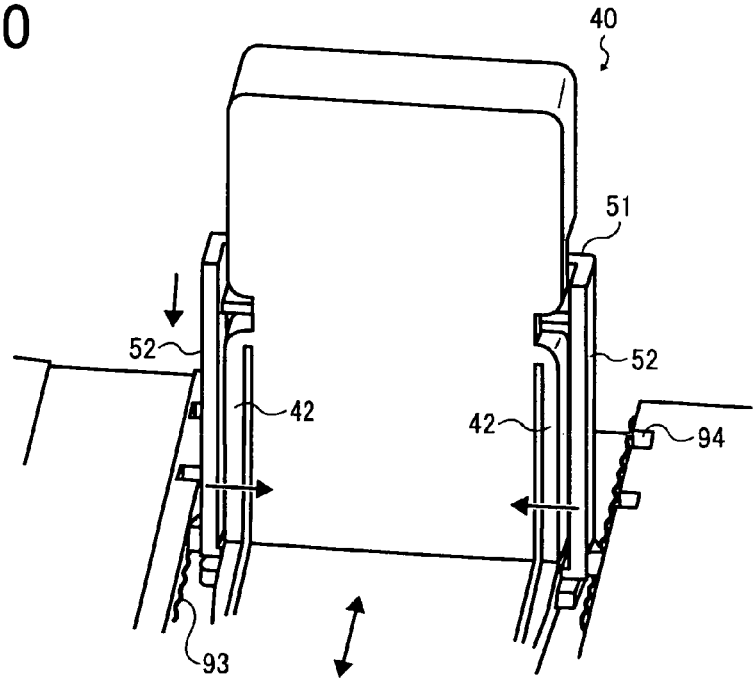
FIG. 10 is a perspective view of the end fence in a first retract position.
Figure 12:
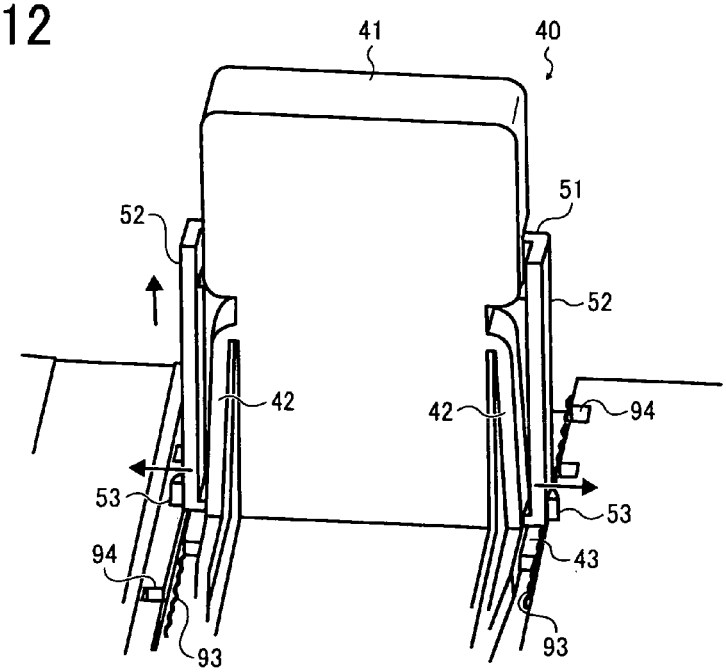
FIG. 12 is a perspective view of the end fence in a second retract position.

When the notch nails 53 and the latch nails 43 are engaged with the notch engaging members 94 and the latch engaging members 93, respectively, then the end fence 40 is referred to be in a locked state (see FIG. 9). When the end fence 40 is moved such that the notch nails 53 and the latch nails 43 are released from the notch engaging members 94 and the latch engaging members 93, respectively, then the end fence 40 is referred to be in a first retract position (see FIGS. 10 and 11). When the end fence 40 is moved such that only the notch nails 53 are released from the notch engaging members 94 and the latch nails 43 remain engaged with the latch engaging members 93, then the end fence 40 is referred to be in a second retract position (see FIGS. 12 and 13). Thus, the end fence 40 can be moved from the locked state to the first retract position and the second retract position, and vice versa.

When guiding the rear edge of paper of a standard paper size, the end fence 40 is maintained in the locked state at a position of the rear edge. To move the end fence 40 to a position for guiding the rear edge of paper of another standard paper size, the elastic arms 52 are pressed inward with, e.g., the thumb and the index finger. As a result, the notch nails 53 get released from the corresponding notch engaging members 94. Moreover, each elastic member 42 gets pressed by a protrusion 52a, which is arranged in each elastic arm 52 on the opposite side of the corresponding notch nail 53, such that the corresponding latch nail 43 is also released from the latch engaging member 93 on the same side. Consequently, if the end fence 40 is moved while the notch nails 53 as well as the latch nails 43 are in a released state, the end fence 40 is considered to be moved to the first retract position.

In that situation, the notch nails 53 make contact with the side walls of the rail 92 (see FIGS. 10 and 11) such that each protrusion 52*a* presses the corresponding elastic member 42 to an elastically deformed state. Consequently, the notch nails 53 and the latch nails 43 are maintained in the released state. Thus, it is possible to easily move the end fence 40 to a desired position without applying much force. If the subsequent pair of notch engaging members 94 corresponds to the desired standard paper size, then the elastic arms 52 can be released at that position such that the notch nails 53 automatically engage with the desired notch engaging members 94 due to the elastic force of the elastic arms 52. The engagement is accompanied by a clicking sound. Moreover, the latch nails 43 also engage with the groove in the latch engaging members 93 at the desired position. Thus, the end fence 40 is maintained in the locked state. However, to further move the end fence 40 to a position corresponding to another desired standard paper size, the elastic arms 52 are re-pressed inward such that the end fence 40 can be moved to the first retract position and then up to the notch engaging members 94 corresponding to the desired standard paper size. At that position, the notch nails 53 automatically engage with the corresponding notch engaging members 94 such that the end fence 40 is again maintained in the locked state.

When a free-size paper is stacked on the paper feed tray 23, the positions of the side fences 80 and the end fence 40 are determined based on the paper size. More particularly, the end fence 40 is first moved to the first retract position and then moved to a position at the rear edge of the paper stack. Subsequently, if the lock releasing member 51 is moved upward, the notch nails 53 move above the rail 92 and the latch nails 43 engage with the corresponding latch engaging members 93 after being freed from the elastic arms 52 (see FIGS. 12 and 13). Thus, the end fence 40 is maintained at the second retract position. Meanwhile, to move the end fence 40 from the second retract position to the first retract position, first, the elastic arms 52 are pressed inward such that the latch nails 43 are released from the corresponding latch engaging members 93. Then, if the lock releasing member 51 is moved downward, the notch nails 53 make contact with the side walls of the rail 92 (first retract position).

Figure 14:
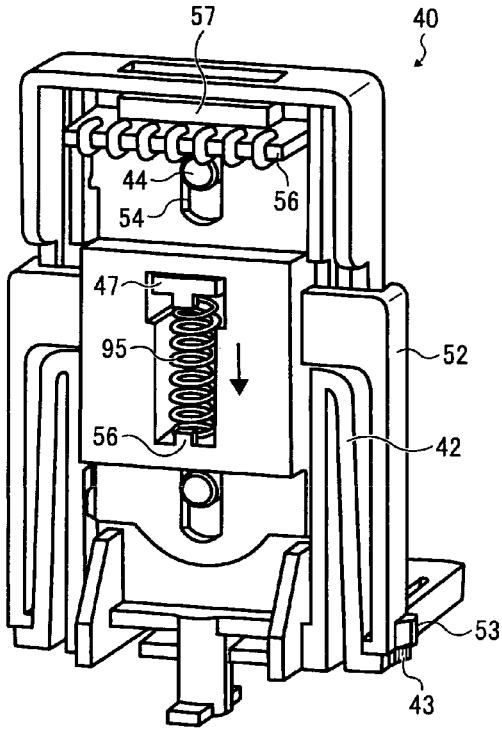
FIG. 14 is a perspective view of an end fence in the paper feed tray according to another embodiment of the present invention.
Figure 15:
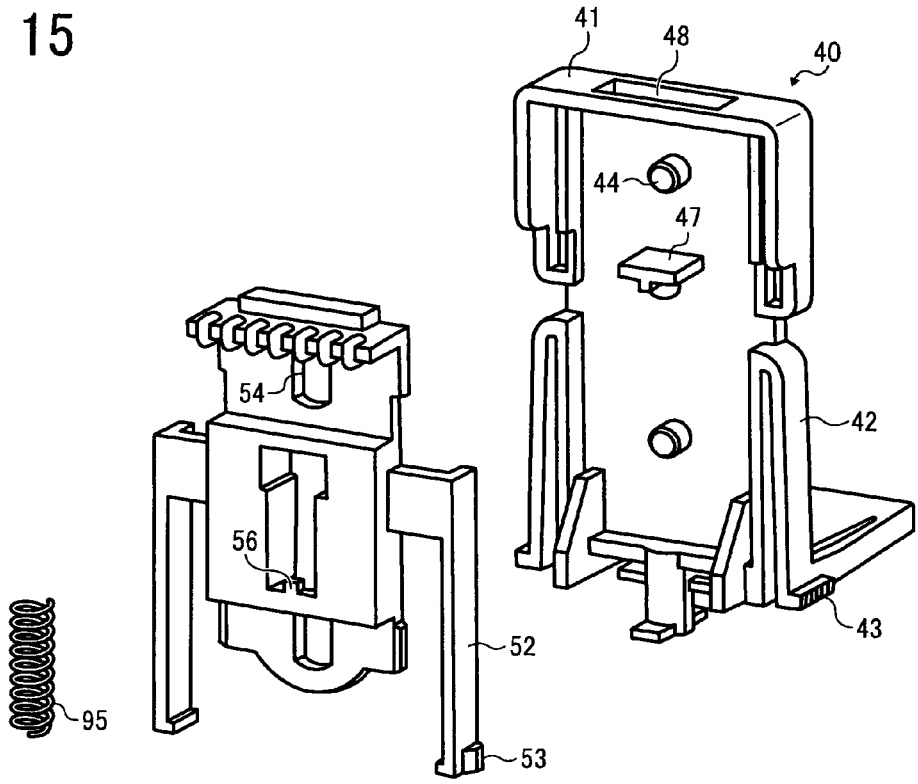
FIG. 15 is an exploded perspective view of the end fence shown in FIG. 14.

Given below is the description of the end fence 40 according to a first modification of the first embodiment. As shown in FIGS. 14 and 15, a pressure spring 95 maintains the lock releasing member 51 downwardly biased with respect to the end fence body 41. The pressure spring 95 is arranged between a protrusion 47 in the end fence body 41 and a spring holding unit 55 in the lock releasing member 51. A see-through window 48 is provided on the top surface of the end fence body 41. A bent portion 56 is provided in the top portion of the lock releasing member 51. A status display 57 that displays information regarding the paper size (e.g., "FREE SIZE") is arranged on the top surface of the bent portion 56.

When paper of a free paper size is stacked in the paper feed tray 23, it is necessary to move the end fence 40 such that it makes slight contact with the rear edge of the paper stack. However, if the elastic arm 52 is made very thin to save space, there is a possibility that the thumb and the index finger make direct contact with the paper stack while pressing the elastic arms 52. In that case, it becomes difficult to move the lock releasing member 51 upward to the second retract position. That problem is solved by holding the bent portion 56 while moving the lock releasing member 51 upward. That serves as an indication to the user that the lock releasing member 51 is being moved to the second retract position.

Figure 16:
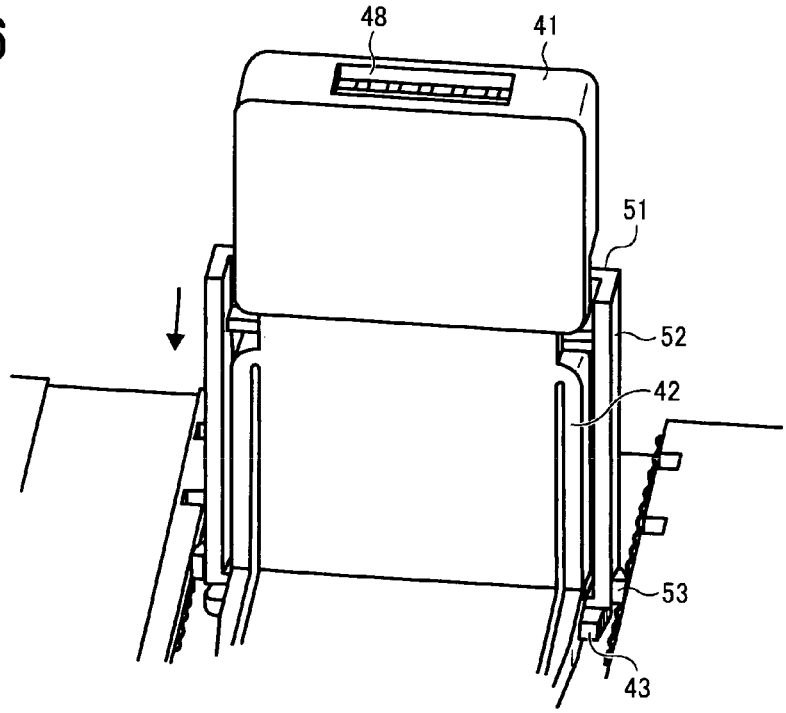
FIG. 16 is a perspective view of the end fence shown in FIG. 14 in a first retract position.

Meanwhile, when the notch nails 53 reach the notch engaging members 94 corresponding to a desired standard paper size, the lock releasing member 51 automatically drops down in the locked state because the pressure spring 95 maintains the lock releasing member 51 downwardly biased with respect to the end fence body 41 (see FIG. 16). Thus, it is possible to reliably maintain the end fence 40 in the locked state at a desired position.

Figure 17:
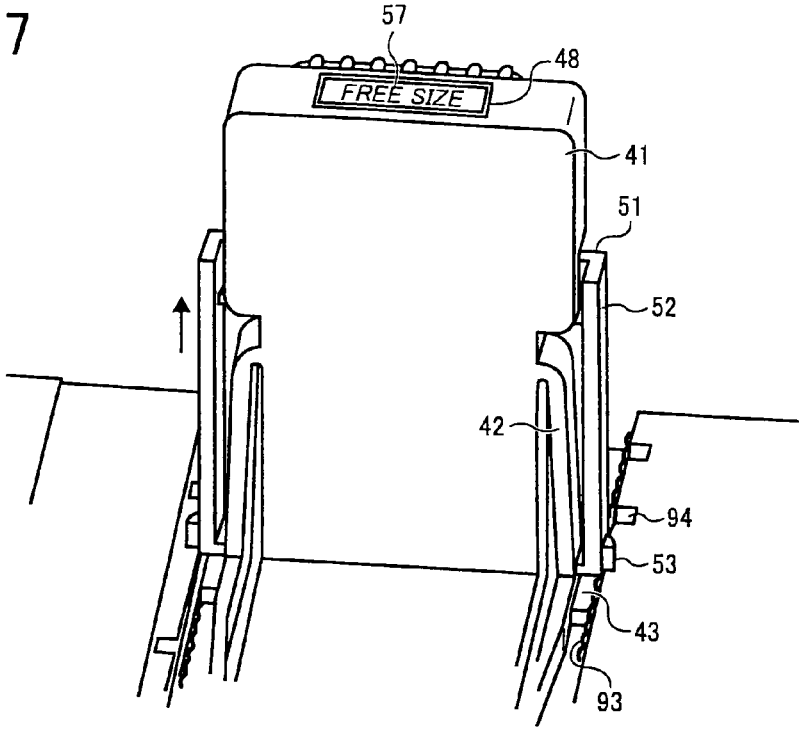
FIG. 17 is a perspective view of the end fence shown in FIG. 14 in a second retract position.

Moreover, when the lock releasing member 51 moves upward to the second retract position for paper of a free paper size, the status display 57 reaches the see-through window 48 such that the status "FREE SIZE" can be viewed therethrough (see FIG. 17). On the other hand, when the lock releasing member 51 drops down to the locked state or the first retract position for paper of a standard paper size, the status display 57 disappears from the see-through window 48 indicating that the end fence 40 is not in a locked state for paper of a free paper size. When it is known that paper of a standard paper size is being used, it is possible to confirm whether the end fence 40 is properly maintained in the locked state at a desired position by moving the lock releasing member 51 upward.

Thus, as described above, it is possible to determine the position of the end fence 40 corresponding to the standard paper sizes as well as a free paper size thereby reducing the risk of missetting the paper stack. That results in enhanced paper feeding and improved image quality in the image forming apparatus 10.

As described above, the notch nails 53 engage with the notch engaging members 94 with a clicking sound indicating that the end fence 40 is locked at a desired position for paper of a standard paper size. The clicking sound can be improved to enable the user in easily recognizing that the end fence 40 is properly locked.

Figure 18:
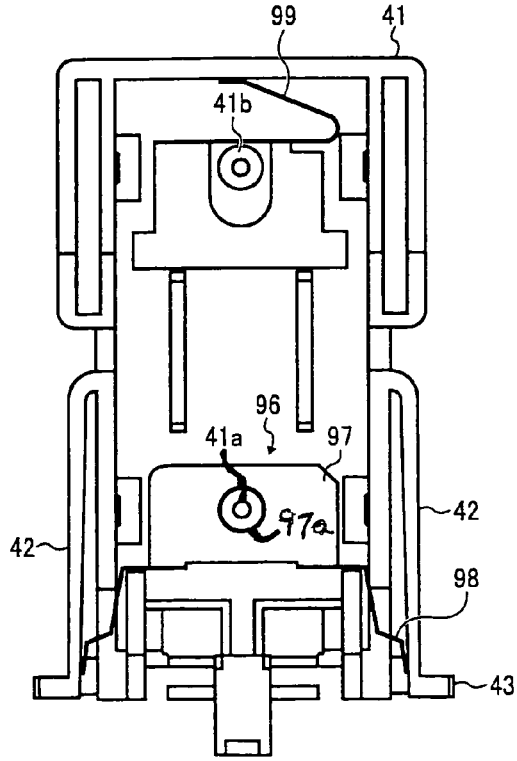
FIG. 18 is a perspective view of the end fence in the paper feed tray according to still another embodiment of the present invention.
Figure 19:
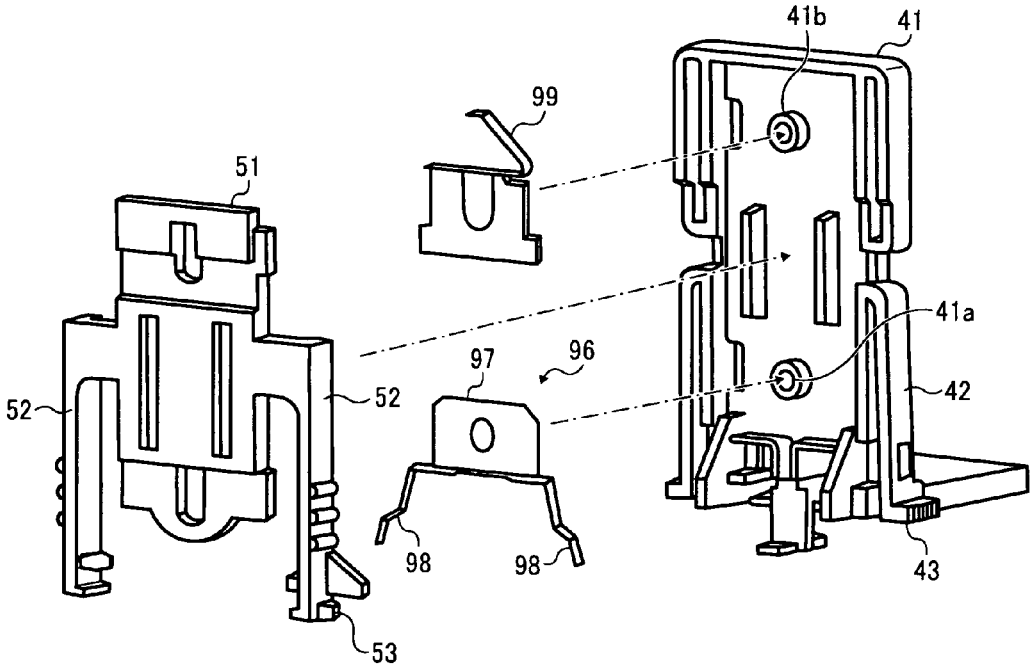
FIG. 19 is an exploded perspective view of the end fence shown in FIG. 18.

To improve the clicking sound, a pressure biasing member 96 is arranged for imparting an elastic force such that each notch nail 53 is maintained biased towards the corresponding notch engaging member 94 (see FIGS. 18 and 19). The pressure biasing member 96 is a thin metal plate that includes a base 97 and two bracket-like springs 98, each arranged on the left side and the right side of the base 97. The base 97 has a hole 97*a* in which a pin 41*a* of the end fence body 41 fits. Each bracket-like spring 98 makes contact with the internal surface of the elastic arm 52 on the same side such that the corresponding notch nail 53 is maintained biased towards the corresponding notch engaging member 94. As shown in FIGS. 18 and 19, a plate spring 99 is arranged instead of the pressure spring 95. The plate spring 99 is supported by a pin 41*b* of the end fence body 41.

Thus, by arranging the pressure biasing member 96, it is possible to improve the clicking sound when the notch nails 53 engage with the notch engaging members 94. Hence, it becomes easy for the user to recognize whether the end fence 40 is properly locked at a desired position for a particular paper size.

Meanwhile, the description of the edge guiding units in the paper feed tray 23 is given mainly with reference to the end fence 40. However, it is also possible to give that description with reference to the side fences 80.

As described above, according to an aspect of the present invention, it is possible to determine a position of an edge guiding unit corresponding to paper of a standard paper size as well as paper of a free paper size.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A recording-medium storage device comprising:

a recording-medium storing unit, arranged in a main body of the recording-medium storage device, to store a recording medium;

an edge guiding unit to guide an edge of the recording medium, movable in a direction to regulate the edge of the recording medium, the edge guiding unit including a first locking member and a second locking member;

a first engaging member for a standard size of the recording medium, arranged in the main body, to make a first engagement with the first locking member to lock the edge guiding unit; and a second engaging member for non-standard size of the recording medium, arranged in the main body, to make a second engagement with the second locking member to lock the edge guiding unit, the second engaging member being different in shape than the first engaging member and an arrangement interval of the second engaging member being smaller than an arrangement interval of the first engaging member, wherein the first locking member is movable from an engaging position engaged with the first engaging member to a first retract position and a second retract position, when the first locking member moves from the engaged position to the first retract position to release the engagement of the first engagement, the second engagement is released, and when the first locking member moves from the engaging position to the second retract position in order to release the first engagement the second engagement being maintained.

2. The recording-medium storage device according to claim 1, further comprising;

a sliding guide unit to guide the moving direction of the edge guiding unit, wherein the first engaging member and the second engaging member are stacked in layers along the sliding guide unit.

3. The recording-medium storage device according to claim 1, wherein the first engagement is maintained by an outward elastic force, and the first retract position is a position obtained by moving the first locking member inward.

4. The recording-medium storage device according to claim 1, wherein the second retract position is a position obtained by moving the first locking member upward.

5. The recording-medium storage device according to claim 1, wherein the first engaging member is arranged at a plurality of positions, and the first engagement at each of the positions determines a locked state of the edge guiding unit corresponding to the standard size of the recording medium.

6. The recording-medium storage device according to claim 1, wherein the second engaging member is arranged at a plurality of positions, and the second engagement at each of the positions determines a locked state of the edge guiding unit corresponding to the non-standard size of the recording medium.

7. The recording-medium storage device according to claim 1, wherein the second locking member is arranged on the edge guiding unit, and the first locking member is arranged on a member that is movably supported in a different direction than a direction of guiding the edge of the recording medium to unlock the edge guiding unit.

8. The recording-medium storage device according to claim 1, wherein the second locking member includes a pressure applying member for applying an elastic force on the first locking member toward the first engaging member.

9. An image forming apparatus comprising a recording-medium storage device including:

a recording-medium storing unit, arranged in a main body of the recording-medium storage device to store a recording medium;

an edge guiding unit to guide an edge of the recording medium, movable in a direction to regulate the edge of the recording medium, the edge guiding unit including a first locking member and a second locking member;

a first engaging member for a standard size of the recording medium, arranged in the main body to make a first engagement with the first locking member to lock the edge guiding unit; and a second engaging member for a non-standard size of the recording medium, arranged in the main body to make a second engagement with the second locking member to lock the edge guiding unit, the second engaging member being different in shape than the first engaging member and an arrangement interval of the second engaging member being smaller than an arrangement interval of the first engaging member, wherein the first locking member is movable from an engaging position engaged with the first engaging member to a first retract position and a second retract position, when the first locking member moves from the engaged position to the first retract position to release the engagement of the first engagement, the second engagement is released, and when the first locking member moves from the engaging position to the second retract position in order to release the first engagement the second engagement being maintained.

10. A recording-medium storage device comprising:

a recording-medium storing unit, arranged in a main body of the recording-medium storage device to store a recording medium;

an edge guiding unit to guide an edge of the recording medium, movable in a direction to regulate the edge of the recording medium, the edge guiding unit including a first locking member and a second locking member;

a first engaging member for a standard size of the recording medium, arranged in the main body, to make a first engagement with the first locking member to lock the edge guiding unit;

a second engaging member for a non-standard size of the recording medium, arranged in the main body to make a second engagement with the second locking member to lock the edge guiding unit, and an arrangement interval of the second engaging member being smaller than an arrangement interval of the first engaging member; and an elastic member, wherein the elastic member deforms by a first amount to move the first locking member to a first retract position, the elastic member deforms by a second amount to move the first locking member to a second retract position, when the first locking member moves from an engaging position engaged with the first engagement member to the first retract position, the second engagement is released in conjunction with a release of the first engagement, and when the first locking member moves from the engaged position to the second retract position in order to release the first engagement the second engagement being maintained.

11. The recording-medium storage device according to claim 10, wherein the second amount of deformation is greater than the first amount of deformation.

12. The recording-medium storage device according to claim 10, further comprising:

a sliding guide unit to guide the moving direction of the edge guiding unit, wherein the first engaging member and the second engaging member are stacked in layers along the sliding guide unit.

13. The recording-medium storage device according to claim 10, wherein the first engagement is maintained by an outward elastic force, and the first retract position is a position obtained by moving the first locking member inward.

14. The recording-medium storage device according to claim 10, wherein the second retract position is a position obtained by moving the first locking member upward.

15. The recording-medium storage device according to claim 10, wherein the first engaging member is arranged at a plurality of positions, and the first engagement at each of the positions determines a locked state of the edge guiding unit corresponding to the standard size of the recording medium.

16. The recording-medium storage device according to claim 10, wherein the second engaging member is arranged at a plurality of positions, and the second engagement at each of the positions determines a locked state of the edge guiding unit corresponding to the non-standard size of the recording medium.

17. The recording-medium storage device according to claim 10, wherein the second locking member is arranged on the edge guiding unit, and the first locking member is arranged on a member that is movably supported in a different direction than a direction of guiding the edge of the recording medium to unlock the edge guiding unit.

18. The recording-medium storage device according to claim 10, wherein the second locking member includes a pressure applying member to apply an elastic force on the first locking member toward the first engaging member.

* * * * *